United States Patent [19]

Kienow et al.

[11] 4,039,280

[45] Aug. 2, 1977

[54] LININGS FOR HIGH TEMPERATURE OVENS

[75] Inventors: Sigismund Kienow, Clausthal-Zellerfeld; Erich Sundermann, Braunschweig, both of Germany

[73] Assignee: Pyro-Zytan GmbH & Co., Braunschweig, Germany

[21] Appl. No.: 596,587

[22] Filed: July 17, 1975

[30] Foreign Application Priority Data

July 22, 1974 Germany ..... 2435146

[51] Int. Cl.[2] ..... F27B 3/14

[52] U.S. Cl. ..... 432/248; 432/252; 110/1 A; 110/1 B; 52/561; 52/567

[58] Field of Search ..... 110/99 A, 99 R, 1 A, 110/1 B; 432/248, 249, 252, 238, 258, 264; 266/43; 13/35; 52/561, 567, 269, 249

[56] References Cited

U.S. PATENT DOCUMENTS

| | | | |
|---|---|---|---|
| 781,746 | 2/1905 | Sheldon et al. | 110/1 B |
| 2,371,201 | 3/1945 | Wells | 52/567 |
| 2,462,289 | 2/1949 | Rochow | 432/252 |
| 2,987,856 | 6/1961 | Longenecker | 110/1 A |
| 3,337,206 | 8/1967 | Bouvier | 266/43 |
| 3,463,865 | 8/1969 | Sarraf | 13/35 |
| 3,528,647 | 9/1970 | Hyde | 110/1 A |

FOREIGN PATENT DOCUMENTS

| | | | |
|---|---|---|---|
| 1,106,446 | 5/1961 | Germany | 110/1 A |
| 816,744 | 12/1951 | Germany | 52/561 |
| 820,499 | 11/1951 | Germany | 52/567 |

*Primary Examiner*—John J. Camby
*Assistant Examiner*—Henry C. Yuen

[57] ABSTRACT

A furnace lining formed from a plurality of blocks each comprising an assembly of stacked parallel plates and at least one profiled or toothed end member. The profiles are shaped to be capable of receiving in spaced relationship in the stack of plates. The profiled teeth of the end members are arranged perpendicularly to the stacking planes of the plates and extend individually laterally over at least a portion of the peripheral edge or corner of each plate so that an effective bond is obtained for the plates, as well as their assemblies.

10 Claims, 7 Drawing Figures

LININGS FOR HIGH TEMPERATURE OVENS

BACKGROUND OF THE INVENTION

The invention relates to masonry linings for high temperature furnaces, S-M ovens (Siemens-Martins), converters, crucibles and similar industrial furnaces, wherein the lining walls are built from masonry-like blocks formed by assemblies of adjacent and superposed plates bound to, and arranged side-by-side with, one another and kept in parallel relationship to the furance wall, wherein the plates have a thickness of at most 50 mm and are made of a non-porous fireproof ceramic material.

While it is well known to provide a lining for the walls and ceilings of industrial furnaces, great difficulties occur, when the lining is built from large-size fireproof blocks made of ceramic materials, such as MgO, $Al_2O_3$,$SiO_2$ and the like. The materials by which such blocks are made have a relatively high thermal coefficient of expansion so that during the heating and cooling of such large-size blocks, undue stresses and strains occur, causing the blocks to burst and to become displaced. Consequently, the known masonry linings quickly disintegrate and decay.

To avoid the foregoing defects, it has been proposed by the German Pat. OS No. 1,758.713, to form oven liners of a plurality of blocks each comprising high density, non-porous ceramic fireproof plates of individual bricks assembled in an interconnected and mutually parallel arrangement. In these known liners, the individual plates are connected to one another by providing in each holes and passing through these holes tie members of sizes corresponding to the dimensions of the holes, so that the plates are sequentially arranged and maintained in position. The plates are spaced by laying them separately on corresponding abutments of the tie members.

There is also a known variant in which the plates in each block assembly are firmly fixed to the tie members and are arranged in a given spaced relationship, so that the plates of adjacent blocks may be allowed to intermesh and form a bond between individual block assemblies.

The above described execution of masonry blocks for linings of industrial furnaces is extremely expensive and highly difficult in manufacture. It is difficult to provide the arrangement of the holes by which the individual plates are connected, and equally difficult to assemble the individual plates on the time members. These special difficulties, connected with the production of the blocks of this nature, as well as with the manufacture of the plates themselves, result from the fact that the plates must be prepared in a press or molding operation, wherein in order to insure the required density for masonry linings and to provide for a high degree of durability and stability in size and shape, in order to enable a correspondingly proper mating engagement, a high degree of manufacturing accuracy and tolerance is required.

The object of the present invention is to provide an improved masonry lining of the above described nature, but avoiding the defects and disadvantages thereof.

It is another object of the present invention, to provide a lining assembled from easily manufactured elements enabling formation of a complete oven wall in a simple operation.

THE PRESENT INVENTION

According to the present invention a furnace lining is formed from a plurality of blocks each comprising an assembly of stacked parallel plates and at least one profiled or toothed end member, made of fireproof ceramic material and shaped to be capable of receiving in spaced relationship the stack of plates. The profiled teeth of the end members are arranged perpendicularly to the stacking planes of the plates and extend individually laterally over at least a portion of the peripheral edge or corner of each plate so that an effective bond is obtained for the plates, as well as for their assemblies.

Preferably, the end member is of a rectangular planar shape and the teeth are formed by providing the face of the end member, in cross section, as a continuous rack in which each tooth has a bottom inclined to the plane of the end member and a side face perpendicular to the plane of the end member. Each profiled toothed end member keeps its assembled plates securely in parallel relationship, so that it is possible for the plates of adjacent block assemblies to engage the corresponding teeth of the adjacent end members providing an overlapped arrangement in which a strong bond is provided between adjacent blocks and any displcement between individual plate assemblies is prevented. By reason of this, the individual plates do not need to be provided with any holes and they need not be linked to one another by the members, in order to form a unitary assembly.

According to the present invention, the border edges of each plate are arranged to engage the teeth of the profiled toothed end members by forming their edges with a corresponding mating configuration, the manufacture of which is a rather simple operation. A conventional press or molding process can be used, which is relatively cheap and provides good quality as well as size and shape accuracy. Durability of the finished end members can be equal to that of the individual plates produced.

Since each of the plates are required only to engage a profiled tooth on its border edge, it is quite apparent, that the construction of the furnace lining is reduced to an extremely simple assembly operation. All the individual block assemblies and their plates may have the same dimensions and have identically formed border edges. As a result, the manufacture of the plates and their storing are substantially simplified, as compared with the prior art.

A special advantage is achieved according to one embodiment of the invention when the end members are provided with teeth located perpendicularly to the stacking planes of the plates. In this manner, each tooth may provide surfaces on their sides which facing the associated plate and engage the side wall of the plate along the entire border edge. In this arrangement, a specifically dense combination of plates in the lining may be obtained, by providing each block with many plates. Since the plates are held together by the end members, enagaging the corresponding associated teeth along virtually their entire length, a construction may be obtained which is equivalent to large masonry blocks of the prior art, without the use of any mortar to bind them or fix them in place. This assembly can be effected by relatively simple operation, wherein each plate is placed in position by sliding it endwise into the corresponding teeth of a pair of oppositely positioned end members. The teeth are being so profiled as to provide slots and shaped surfaces for the retention of the plates.

The plates of one block being surrounded by other blocks may be separated from the adjacent plates by the provision of profiled end members positioned therebetween. That is, the end member of one block may also be the end members of the adjacent block. In this way, a wall lining structure may be provided in the form of a compact system of blocks in which no gaps or openings requiring separate sealing appear. Moreover, any sealable slot which might exist runs along the profile of the teeth and is thereby a labyrinth seal formed by the changing direction of each tooth on the profiled member. As a result, a block may be formed from plates, each having a thickness of between 20 and at most 50 mm, and which are spaced one from another by a small amount, allowing the plates freedom to expand when they are heated and which are not prevented from bowing-out. Thus, the plates are capable during use, of filling in the spaces within the block, except for an extremely narrow gap separating adjacent plates, as well as filling in the remaining narrow gaps around their border edges, so as to engage and provide a tight form fit with the teeth of the profiled toothed members.

The profiled members, when employed to surround the individual plate assemblies, advantageously form a cohesive covering unit. For this purpose, it is preferable, according to an embodiment of the invention, that in the vertical walls forming the lining, the vertical profile member is provided along the entire height of its face with vertically oriented teeth and its horizontally extending edges with a toothed surface capable of matching to, and engaging with the teeth of the contiguous horizontally extending profiled end member. In this connection, the horizontally extending end members are formed in a manner such that they have a length which reaches beyond the assembled plates by one half of the thickness of the contiguous vertically positioned end members, so as to engage therewith. These extensions, on the horizontally positioned end members, may have flat frontal edge surface, so that they may abut adjacent members, which also engage the vertically positioned walls.

However, the profiled end members need not necessarily to be formed as horizontally and vertically disposed rectangular plates, as described herein above. In another embodiment of the invention, the profiled members are formed as toothed or racked strips or beams insertable within a corresponding slot or cut-off provided on the edges of the plates. From practical point of view, such strips are equivalent to the earlier described rectangular members, except that they are arranged in the corresponding slot, so that the plates of one block can be placed abuttingly next to the plates of adjacent blocks, without the formation of a gap or opening between them. To this end, the individual plates of each block assembly may have mating edge profiles, such as for instance a set-off border or dove tail edge or keying edge profile, adapted to engage corresponding counter-profiles of the adjacent plates. In any case, this kind of edge profiling requires the provision of at least two different plate types, or, if one plate type is used, requires that they be at least in reversed positions in relation to one another.

The teeth on either the profiled rectangular end members and the profiled end strips, may be executed in various manners. It is possible to provide teeth wherein the surfaces delimiting the teeth are positioned at right angle to each other. In this case, the plates in each block assembly must be formed with similarly square shaped edges, so that they reach into the cavities provided by the teeth and also engage on a portion of their wall thickness the surfaces of the teeth, leaving only a negligible gap of one or only several millimeters between the plates.

The teeth may also be formed differently than with right-angle contacting surfaces. In a specifically advantageous embodiment the teeth are formed with a sawtooth cross-section having at least one inclined surface. In this case, the plates engage the teeth on correspondingly bevelled edges or portions thereof. With this embodiment, particularly simple forms of block assemblies can be made, which in combination with other assemblies will provide smooth flat walls, irrespective of the structure of the oven lining. In this embodiment, the bevelled surfaces provided on both the teeth of the end member and the plate edges enable the shifting and expansion of the elements during use, resulting in a self-stiffening and strengthening action between the end members and the plates. Thereby, the otherwise necessary expansion gaps needed in fixed mansonry work are evidently unnecessary in this kind of structure.

In another embodiment of the invention, a special step may be taken, to avoid thermal stresses and splitting of the border portions of the plates, as well as of the profiled members. Here, the teeth of the end member is executed with rounded edges and accordingly also the engageable edges of the plates to be arranged thereon are provided in the region of their engagement with the teeth with rounded profiles.

Where it is necessary to form the oven lining in an arc or a rounded shape, a relatively simple measure may be taken, wherein the profiled end members are formed in a conical shape.

Where the stability requirements for the oven lining are particularly high, and use is made of the plates of the above described nature, the plates may be coated with an appropriate binder providing under heat a firm bond between it and the plates in the plate assemblies, without diminishing in any regard its fireproof character. In case basic blocks are employed, such as magnesium or chrommagnesium blocks, it is preferable to immerse them into am iron-oxide sludge or into thin flowing hot tar.

The stability of the oven lining can be further improved by fastening the plates of the block assembly, at their ends, facing the furnace wall, to the steel structure of the furnace.

The structure of the oven lining as described herein above in regard to the wall thereof is also utilizable for providing the furnace ceiling with the necessary lining. In this case, the vertically extending profiled end members are formed with extensions and with corresponding surfaces for abutment of the furnace ceiling.

Where the lining of this nature is to be provided also on the floor, similarly as in case of the ceiling lining, the plates arranged in the individual block assemblies are arranged parallel to each other and horizontally in regard to the corresponding furnace walls.

PREFERRED EMBODIMENT

Figure 1:
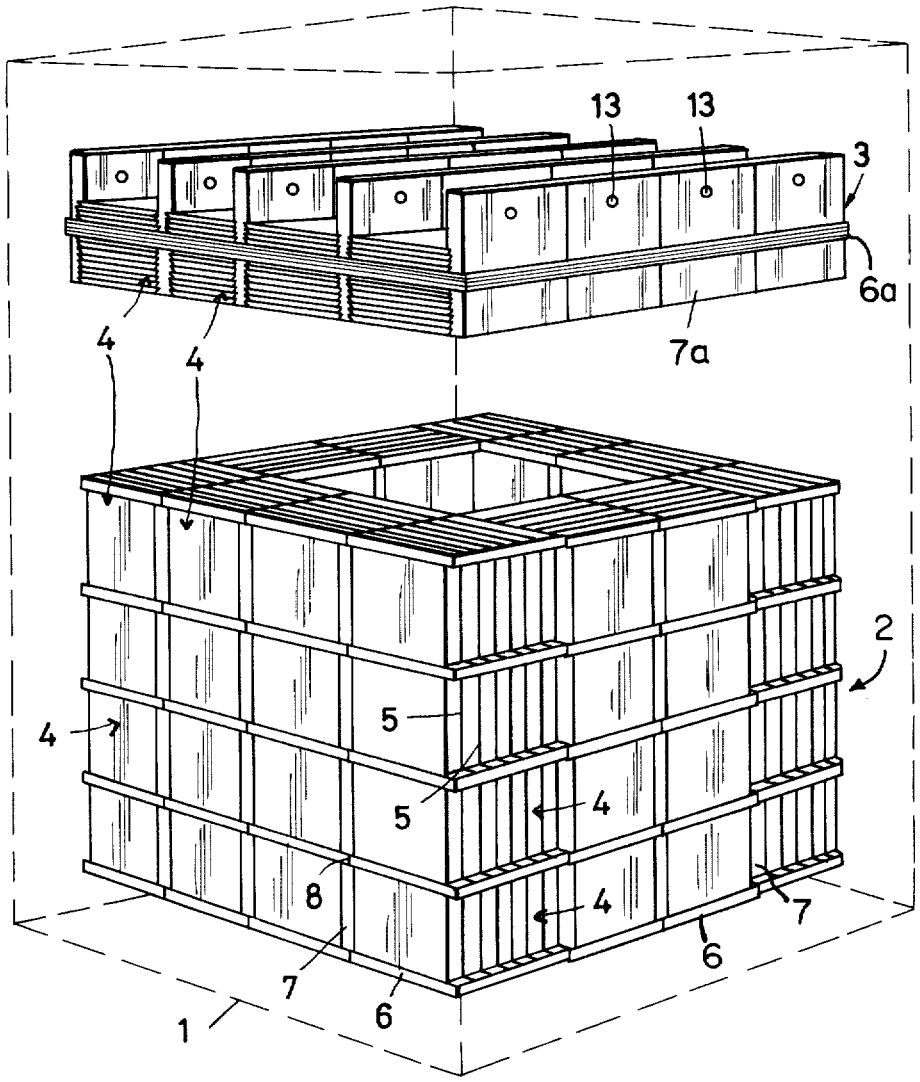
FIG. 1 is a view of a furnace lining embodying the principles of the present invention having a furnace ceiling arranged thereover and shown therefrom.

In FIG. 1, the steel super-structure 1 of a furnace is shown in dot-dashed lines. Within the furnace there is located a peripheral section 2 of a ceramic lining, formed in accordance with the present invention, above which a ceiling portion 3 is shown. The ceiling is supported by a not shown bridge-like carrying structure provided on the top of the steel super-structure.

Figure 3:
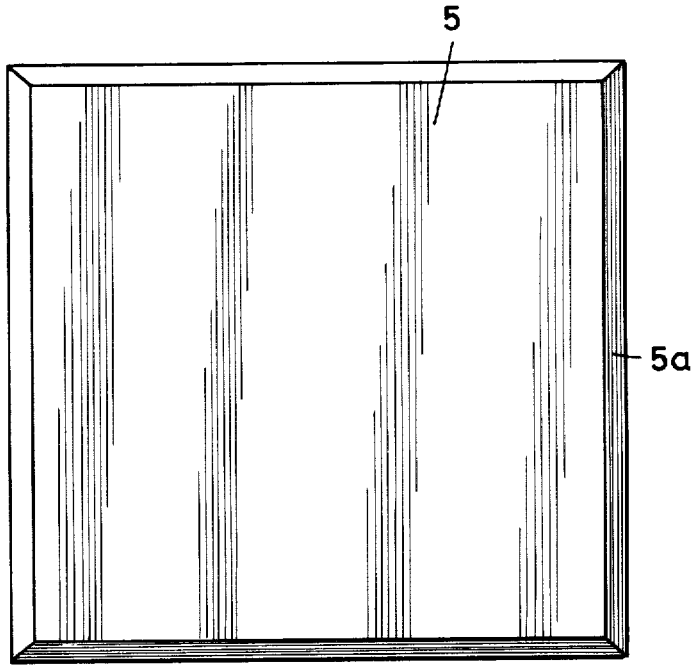
FIG. 3 is a plan view of a plate used to form the blocks.
Figure 4:
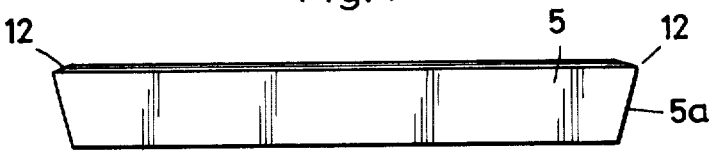
FIG. 4 is an end view of a plate shown in FIG. 3.

The peripheral section 2 of the furnace lining comprises adjacent and superimposed rectangular blocks 4. Each of the blocks comprise an arrangement of a plurality of generally flat rectangular brick-like plates 5, such as shown in detail in FIGS. 2 - 4, and horizontal profiled end members 6 and vertical profiled end members 7, such as also shown in detail in FIGS. 2, 5 and 6. The blocks 4 are arranged contiguously adjacent and superimposed to each other in vertical and horizontal rows, so as to form a continuous border around the inside of the furnace, free of any gaps or spaces therebetween. The plates 5 in each block 4 are arranged vertically in mutually parallel relationship to each other and to the plane of the adjacent wall of the furnace 1. Each of the end members are provided with teeth, or profiled surfaces by which the individual plates 5 are positioned and by which they are properly maintained and supported in vertical upstanding parallel arrangement. The plates 5 as seen in FIG. 1 may be completely enclosed by the horizontal and vertical end members 6 and 7, to form a complete boxed-in block 4, or may, if desired, be left open at selected faces. Preferably, of course, end members serve to enclose two adjacent sets of plates, reducing thereby the member of end members necessary and also provide additional strength and stability, because of the interconnection between adjacent blocks.

Figure 2:
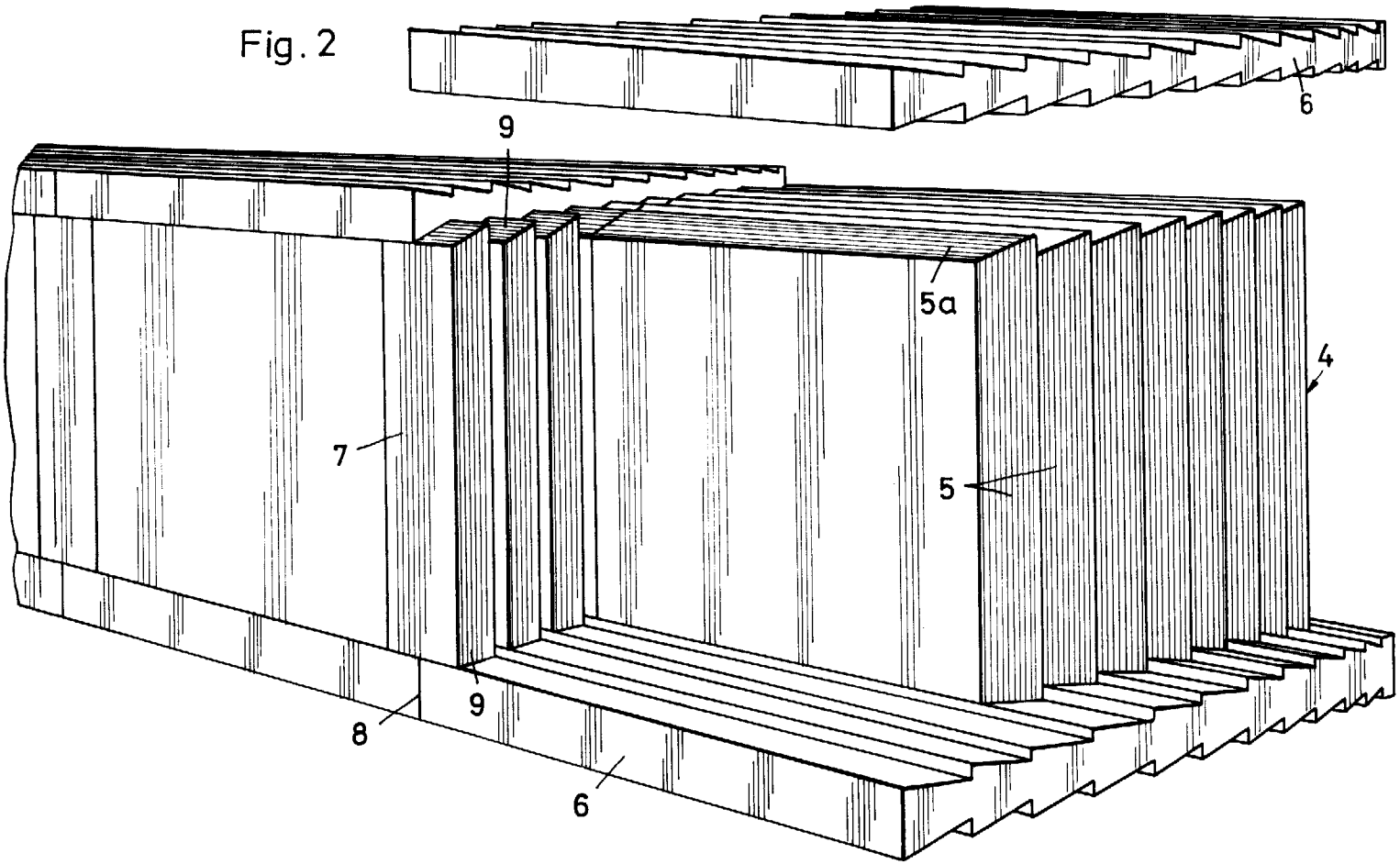
FIG. 2 is a view showing in larger scale a section of the structure illustrated in FIG. 1.
Figure 5:
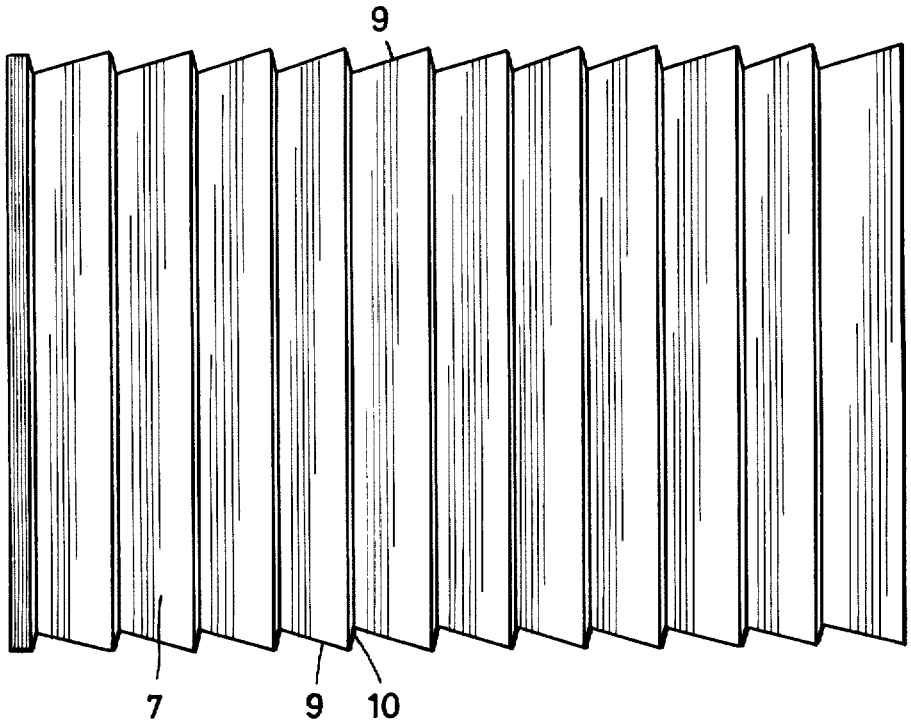
FIG. 5 is an elevational view of a vertical profiled end member for the vertical wall of the block assembly.
Figure 6:
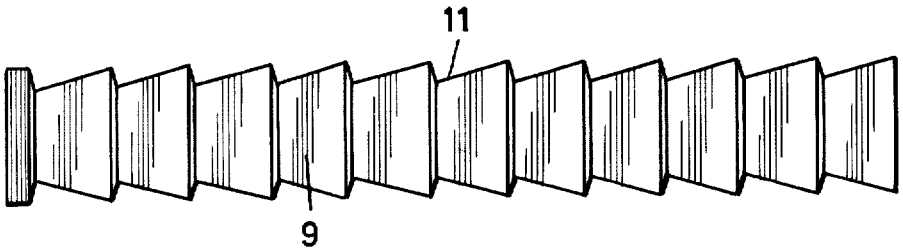
FIG. 6 is an end view of the member shown in FIG. 5.

As seen in detail in FIGS. 2, 5 and 6, the faces of each of the horizontal end members 6, as well as the vertical members 7, adapted to engage the plates 5 are formed with toothed racked or groove surfaces, the individual teeth being arranged so that the edges of the plates 5 may engage therewith, maintaining the plates parallel to one another and also parallel to the corresponding walls of the furnace. In the illustrated embodiment wherein the profiled end members 6 and 7 are provided with a saw-tooth profile having bottom wall and side wall, inclined and perpendicular respectively to the plane of the member. The plates 5 are formed with similar bevelled border edges 5*a* so as to fit into and matingly seat with the individual teeth. The arrangement is made for both the teeth of the horizontal end members 6 and for the vertical end members 7. The pitch or distance between the teeth, and the thickness of the plates 5, are made so that a slight space will exist between adjacent plates.

The peripheral edges of the horizontal end members 6 have flat frontal surfaces 8 permitting adjacent horizontal end members to abut in flush manner when laid next to the other (FIG. 2). Preferably, the horizontal end members 6 have a length which is greater than that of the plates 5 so that they extend beyond the vertically located end member 7, by one half of the thickness of the vertical member 7. The vertically positioned end members 7, thus, overlap contiguous horizontal end members. To accomodate the arrangement the vertical end members 7 are formed with teeth not only on their flat faces engaging the plates 5 but also on at last their horizontally extending peripheral edges 9. The vertical end membrs 7 have a height equal to that of the engaged plates 5 and a peripheral profile conforming to that profile on horizontal end member 5. The outer peripheral edges of the vertical end members are flat so that they lie flush with the edges of the horizontal end members. In this way, the engagement is made possible between the horizontal end members 6 and the teeth 9 of the vertical end members 7.

FIG. 2 provides a better illustration of the interconnection, mating and overlapping of the end members by showing in exploded view a section of the lining of FIG. 1 with an upper horizontal end member 6 lifted from contact with the contiguous vertical end members and plates. Thus, an easily understandable showing is made of the co-operative adjustment of the plates 5 and of the profiled end members 6 and 7. From a practical viewpoint, FIG. 2 displays a section of one of the lining walls forming the lining in a melting crucible.

FIG. 5 shows a side view of the vertically positionable profiled end members 7 such as those illustrated in FIG. 1, from which there is clearly visible saw-tooth or bevelled rack profile of the teeth 9 provided on the horizontal frontal faces, as well as the profile of the conforming teeth of the plates 5 facing the same. The profile of the peripheral edge, as well as the frontal faces, is particularly visible in FIG. 6 illustrating the profiled member 7 shown in FIG. 5 in end view. One will observe from both FIGS. 5 and 6 that the saw-tooth profile is not illustrated, merely as having a sharp zig-zag profile, but that the individual surfaces delimiting the surfaces of each tooth have transitional corners which are rounded as at numerals 10 and 11. Corresponding round corners 12 are also on the plates 5, as clearly shown in FIG. 4, in order to obtain a matching interrelationship.

In the embodiment of FIG. 1 the tub or vessel-like lining for the peripheral side walls of the furnace are shown, while the lining for the floor of the furnace is not illustrated. The floor lining may be executed in any form presently known in the art, although it is preferred that it be built up in combination with the lining illustrated in FIG. 1 and particularly similar to the ceiling structure 3, to be described hereinafter.

It is apparent that while the ceiling 3 may be formed similarly at the wall lining, from a plurality of blocks 4 each having plates 5, the plates 5 must, however, be laid horizontally so that they run parallel to the steel ceiling structure of the furnace 1. Also, here, while the plates 5 are supported only by vertical end members 7*a*, the assembly can be firmly interconnected and bound together by arranging a horizontal separator 6*a* between superimposed blocks 4. The end members 7*a* correspond to the horizontal profiled end members 6 of the earlier described lining and have flat vertical edges adapted to abut one another to form a continuous wall. Transverse, vertical members may be used, but, as illustrated, are not necessary. On the other hand, the horizontal edges, of the vertical members *7a*, must be provided with teeth, as was described in connection with the members 7 of the previous embodiment, so that a secure connection can be made between these vertical members *7a* and the horizontal disposed separating plate *6a*. Thus, the separating plate *6a* must provide connection to the profiled members *7a* and are therefore toothed or racked not only on their faces engaging the plates 5, but also on their frontal surface, engaging the profiled members *7a*. The vertical end members *7a* of the ceiling lining 3 are also formed with upward extension in which holes 13 are bored so that a suspension arrangement may be fastened to it by which the ceiling lining 3 is secured to the frame of the furnace.

From the Figures it is apparent that the plates 5 leave only a narrow space or gap between each other in each block, so that no straight smooth path is created from the inner enclosed area defined by the lining and the outside of said lining. Instead, through the combination of and interconnection of the plates and blocks, a labyrinth-seal is created along the teeth of the profiled members. In addition, the interconnection binds together the plates and the blocks into a unitary whole. At most, there could exist only very small gaps between the butt edges of the individual lining portions. Notwithstanding, this construction allows the individual plates 5, which are all identical, to have space for free play and sliding movement on the respective teeth permitting their expansion when exposed to different thermal stresses and conditions. In addition, the space between the plates permits a slight bowing in both directions without interference with any other plate, or loss of integrity or stability.

Figure 7:
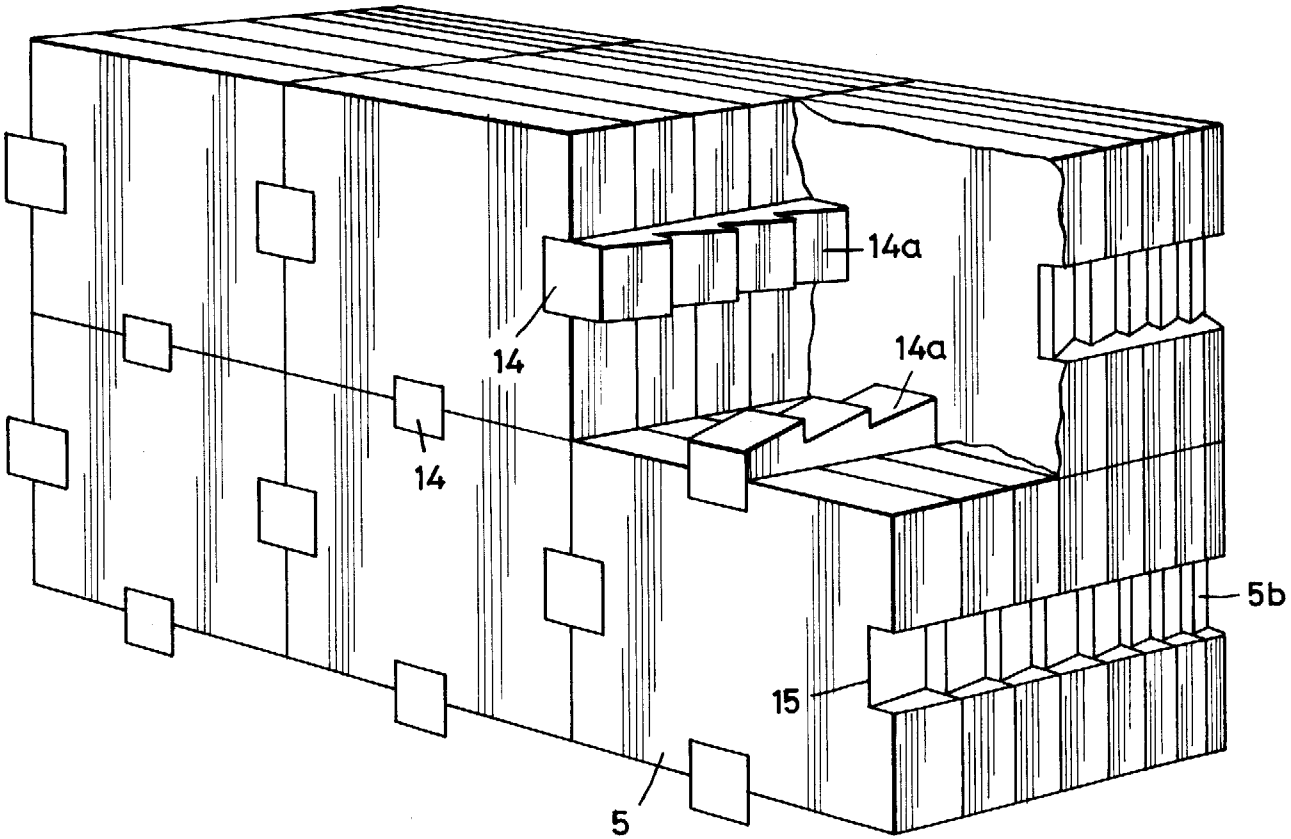
FIG. 7 is a sectional view of the wall of a lining similar to that shown in FIG. 1, illustrating the use of a toothed strip.

FIG. 7 shows, in cross-section, another embodiment of the invention generally similar to that illustrated in FIG. 1. In this embodiment, however, the plates 5 are not kept in their assembled arrangement by rectangular planare end members such as those number 6 and 7 in FIG. 1. Here, instead, toothed or rack strips 14 are provided preferably sufficiently reigid to form beam-like members. The plates 5 are cut-out transversely at the center point along each peripheral edge to form corresponding slots 15 wherein the strips can be received. Each of the slots 15 is formed with inclined surfaces *5b*, corresponding to the incline of the tooth portion 14*a* of the strip 14 and length equal to the number of plates set therein so that the end of the strip terminates with the outerplates. Merely for the purpose of simplification, FIG. 7 shows the arrangement of the plates 5 in a manner such as if there were between the individual plates in the plate blocks no space or gap, however, in the practice, a small space or gap does exist permitting expansion and bowing, as has already been explained. The width of the strips is preferable twice that of each of the slots so that the plates of adjacent blocks will abut in contiguous manner.

The construction of the lining according to either embodiment of FIGS. 1 and 7 is extremely easy and may be executed without any special use of mounting tools. A very stable bond is obtained, as well as a very good sealing of all joints and engaging surfaces. The lining is made of a small number of parts, i.e. of the plates and the profiled end members.

It is quite clear that the connecting end members need not necessarily be of a saw-tooth profile, since the toothing on them and the edges of the plates may be executed in other forms, provided a good interconnection of the plates and of the plate blocks and a good seal without the use of any sealing means is secured.

The plates as well as the profiled members may be manufactured from the known materials having the fireproof characteristic needed for furnaces, such as magnesia, chromium, chrommagnesia, carborundum, zirconium, silica and the like, wherein the grain size is for instance 40 $\mu$, at most, and the individual plate thickness between 20 and 50 mm.

The blocks may be made in various shapes and sizes to fit any furnace or crucible. The blocks may have curved plates for example or planar plates, provided the flat spaced stacking can be arranged. Conically shaped blocks, or blocks of small wedge shape, with similar but progressively sized plates can be made, which blocks may be assembled with others to provide arched or vaulted walls.

Various changes, modifications, size parameters and other details have been stated and set forth earlier in this disclosure. This application will be obvious from the foregoing details and the need to repeat them here is not believed necessary, since reference can be easily made to them. Other modifications, changes, and embodiments will be obvious to those skilled in this art and the present disclosure, therefore, is intended to be taken as illustrative only and not as limiting of the present invention.

What is claimed:

1. A lining for the walls of a high temperature furnace and the like, comprising a plurality of adjacently disposed and superimposed layers of blocks of a refractory material, each of said blocks being formed by an assembly of a plurality of relatively thin plate elements arranged in spaced face-to-face parallel relationship to each other and to the associated adjacent walls of the furnace and stacked in relative alignment with the like plates in the adjacently disposed blocks, said blocks being separated by end members extending perpendicularly to the plane of the plates within said blocks, the faces of each of said end members having slots, each of the slots receiving at least a portion of the edges of a corresponding contiguous one of said plate elements therein to maintain each said plate element spaced from the adjacent plate elements in said block and provide a firm interconnecting bond therebetween.

2. The lining according to claim 1 wherein said plates are formed of a non-porous fireproof ceramic material having a thickness of at most 50 millimeters.

3. The lining according to claim 1 wherein said slots are formed by a series of teeth facing said plate elements, said teeth being adapted to engage the corresponding edge of said plate elements along the entire length thereof.

4. The lining according to claim 3 wherein at least some of said end members extend vertically to the wall of said furnace, and some of said end members extend horizontally, the height of said vertical end members corresponding to that of the plate elements in the associated block and having teeth along their horizontally extending edges forming grooves therein adapted to engage the teeth on the face of the contiguous horizontal end members so as to interlock therewith.

5. The lining according to claim 3 wherein said plate members are in the form of strips and said plate elements are provided with recesses formed in the edges thereof contiguous with said strips for receiving the same.

6. The lining according to claim 1 wherein said end members are formed with a saw-tooth configuration on the faces engaging with said plate elements, and said plate elements are formed with correspondingly bevelled edges.

7. The lining according to claim 6 wherein the toothed configuration of the end members is provided with rounded edges and the engaging edges of the plate elements are provided in the region of their engagement with the teeth with correspondingly rounded configurations.

8. The lining according to claim 1, wherein at least some of said end members are conical in cross section to form arched wall sections.

9. The lining according to claim 1 wherein said members are substantially thin rectangular slabs of refractory material.

10. The lining according to claim 1 including end members arranged along each of the peripheral edges of said plate elements.

* * * * *